United States Patent [19]

Vernhout

[11] 3,935,052

[45] Jan. 27, 1976

[54] ACID ENGRAVING MACHINE DEVICE

[75] Inventor: Hendrik J. Vernhout, Hamilton, Canada

[73] Assignee: The Raymond Lee Organization, Inc., New York, N.Y. ; a part interest

[22] Filed: July 31, 1974

[21] Appl. No.: 493,470

[52] U.S. Cl. ..... 156/345; 156/7

[51] Int. Cl.[2] ..... C23F 1/02

[58] Field of Search ..... 156/7, 345, 62; 401/205, 401/209, 217, 263, 270

[56] References Cited

UNITED STATES PATENTS

| | | | |
|---|---|---|---|
| 2,452,504 | 10/1948 | Tefft | 401/217 |
| 2,502,866 | 4/1950 | Lust | 401/209 X |
| 2,568,803 | 9/1951 | Guenst | 156/7 X |
| 2,578,918 | 12/1951 | Boddy et al. | 401/263 X |

*Primary Examiner*—William A. Powell

*Attorney, Agent, or Firm*—Howard I. Podell

[57] ABSTRACT

An acid engraving device containing a reservoir for acid, a valve to meter the acid flow from the reservoir, and a ball point etching pen to apply acid to the work surface.

1 Claim, 2 Drawing Figures

ACID ENGRAVING MACHINE DEVICE

SUMMARY OF THE INVENTION

My invention relates to an acid engraving device and particularly to a device in the form of a writing instrument, with an acid reservoir, a metering valve to regulate the flow of acid and a ball point etching pen to apply the acid to the work surface. The device is in the form of a cylindrical container with a filler opening fitted at one end enclosed by a screw cap. The lower external portion of the device is threaded to fit a pantograph arm, and a washer and nut are mounted on the threads for adjustment of the device in a pantograph apparatus.

BRIEF DESCRIPTION OF THE DRAWING

The objects and features of the invention may be understood with reference to the following detailed description of an illustrative embodiment of the invention, taken together with the accompanying drawings in which.

DESCRIPTION OF THE PREFERRED EMBODIMENT

Figure 1:
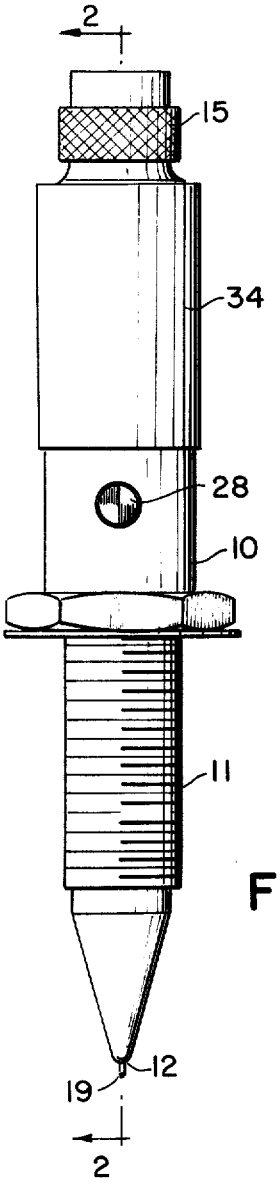
FIG. 1 is an elevation view of the invention.
Figure 2:
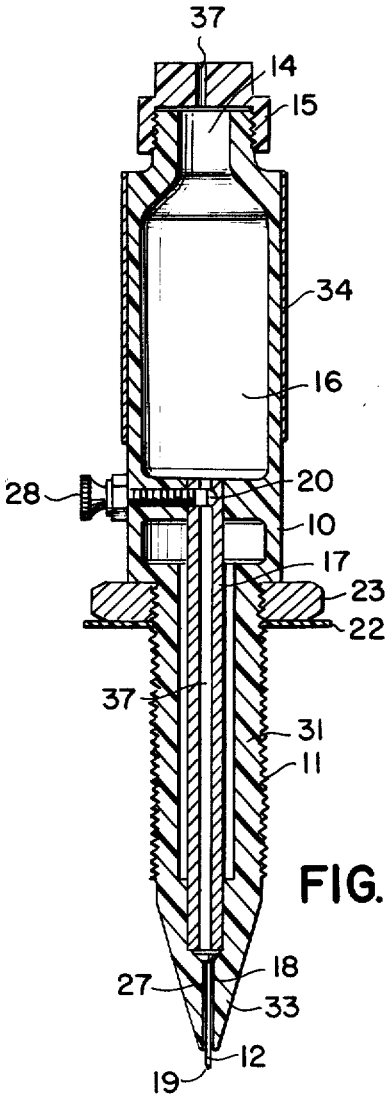
FIG. 2 is a section of the invention along line 2—2 of FIG. 1.

Turning now descriptively to the drawings, in which similar reference characters denote similar elements throughout the several views, FIGS. 1–2 illustrate the invention 10 in the general form of a cylinder, formed with an external screw thread 11 on the lower portion of the body 31 for mounting in a threaded pantograph arm (not shown). A nut 23 and washer 22 are fitted over the threads 11 for locking to the pantograph female threads.

An acid reservoir 16 is fitted in the upper portion of the body 31 and formed with a filler opening 14 capped by a threaded cap 15 fitted with a vent hole 37. A tube 17 leads from the acid reservoir 16 to the etching pen 19, with the opening 37 of the tube regulated by a screw valve 20 which is threaded in the body 31, transverse to the axis of the tube opening 37, with the valve screw head 28 extending externally of the body 31.

The tube 17 extends from the acid reservoir to the tapered tip end 33 of the body 31, in which the pen 18 is mounted in an axial hole 27. Pen 18 is a tube formed with an axial hole of a diameter of 0.002 inches to 0.004 inches in size, that is fitted at its external end 12 with a rollable stainless steel ball 19, with the external end 12 of the pen 18 projecting beyond the tip end 33 of the body 31.

The upper section of the body 31 of the device is housed snugly in a stainless steel tube 34 for structural purposes, with the body 31 and the internal tube 17 formed preferably of a plastic material that is unaffected by the etching acid employed.

The invention is supplied to the engraving trade together a kit of bottles containing various types of acid necessary to engrave different metals such as gold, silver, platinum, bronze, brass, aluminum, steel and stainless steel. Preferably such bottles are each of a volume of 2.65 to 3 cubic inches and individually fit into marked compartments in the box of the kit, which is fabricated of acid-proof material.

The acid reservior 16 of the engraving pen 10 is filled from one of such bottles with the acid required to etch the particular metal being engraved.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A pen device for use in engraving, adaptable for mounting in an arm of a pantograph, said device incorporating a housing body comprising:

an internal refillable acid reservoir, a hollow axial tube leading from the acid reservior to a pen member which projects through an end tip of the device, said pen member being in the form of a hollow tube fitted at its external end with a rollable stainless steel ball, with a valve member in the form of a screw that is mounted transversely to the said hollow axial tube, said screw extending externally of the device and threaded in the housing so as to extend beyond the periphery of the housing, in which the acid reservoir is open at an end of the housing and is covered by a removable threaded cap, said cap fitted with a vent hole, said housing body fitted with means to attach to the arm of a pantograph.

* * * * *